US010450939B2

(12) United States Patent
West et al.

(10) Patent No.: US 10,450,939 B2
(45) Date of Patent: Oct. 22, 2019

(54) MULTIPLE PLANE RECIRCULATION FAN CONTROL FOR A COOLING PACKAGE

(71) Applicant: DEERE & COMPANY, Moline, IL (US)

(72) Inventors: Sean P. West, Dubuque, IA (US); Steven R. Sass, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 550 days.

(21) Appl. No.: 15/140,964

(22) Filed: Apr. 28, 2016

(65) Prior Publication Data

US 2017/0314453 A1 Nov. 2, 2017

(51) Int. Cl.

| | |
|---|---|
| ***F01P 3/18*** | (2006.01) |
| ***F01P 7/04*** | (2006.01) |
| ***F01P 11/10*** | (2006.01) |
| ***F01P 11/12*** | (2006.01) |
| *F01P 5/02* | (2006.01) |

(52) U.S. Cl.

CPC ..... *F01P 3/18* (2013.01); *F01P 7/04* (2013.01); *F01P 11/10* (2013.01); *F01P 11/12* (2013.01); *F01P 2003/182* (2013.01); *F01P 2005/025* (2013.01)

(58) Field of Classification Search

CPC .. B60K 11/02; B60K 11/04; F01P 5/02; F01P 2005/025; F01P 3/18; F01P 2003/182; F24F 11/77

See application file for complete search history.

(56) References Cited

U.S. PATENT DOCUMENTS

| | | | |
|---|---|---|---|
| 6,695,047 | B2 | 2/2004 | Brocksopp |
| 6,809,484 | B2 | 10/2004 | Makaran et al. |
| 6,817,831 | B2 | 11/2004 | Stevens et al. |
| 6,910,529 | B2 | 6/2005 | Stone et al. |
| 7,051,786 | B2 | 5/2006 | Vuk |
| 7,267,086 | B2 | 9/2007 | Allen et al. |
| 7,325,518 | B2 | 2/2008 | Bering |
| 7,373,779 | B2 | 5/2008 | Czachor |
| 7,406,835 | B2 | 8/2008 | Allen et al. |
| 7,484,378 | B2 | 2/2009 | Allen et al. |
| 7,537,072 | B2 | 5/2009 | Sturmon et al. |
| 8,015,954 | B2 | 9/2011 | Kardos |
| 8,347,994 | B2 | 1/2013 | Bering et al. |
| 8,556,013 | B2 | 10/2013 | Sturmon et al. |
| 8,622,162 | B2 | 1/2014 | Karl |

(Continued)

*Primary Examiner* — Eric S Ruppert

(74) *Attorney, Agent, or Firm* — Taft Stettinius & Hollister LLP; Stephan F. Rost

(57) ABSTRACT

A multiplane fan cooling system and method is disclosed for a cooling system with first, second and intake planes; a first fan and heat exchanger on the first plane, a second fan and heat exchanger on the second plane, and a shared air cavity bounded at least partially by these three planes. Each fan pulls air into the shared air cavity through the intake plane and across its associated heat exchanger. The first fan cools the first heat exchanger, and counteracts the second fan from drawing air into the shared air cavity through the first heat exchanger. The second fan cools the second heat exchanger. The second fan can be activated to counteract the first fan from drawing air into the shared air cavity through the second heat exchanger. All the air in the shared air cavity can be available to each of the fans.

8 Claims, 5 Drawing Sheets

(56) References Cited

U.S. PATENT DOCUMENTS

| | | | | |
|---|---|---|---|---|
| 8,826,893 | B2 | 9/2014 | Marsh et al. | |
| 8,919,300 | B2 | 12/2014 | Klinkert et al. | |
| 8,936,122 | B2 | 1/2015 | MacGregor et al. | |
| 2005/0006048 | A1* | 1/2005 | Vuk | B60K 11/04 165/41 |
| 2008/0038111 | A1 | 2/2008 | Iwasaki et al. | |
| 2009/0175745 | A1 | 7/2009 | Usami | |
| 2010/0114379 | A1* | 5/2010 | Sato | F24F 1/38 700/275 |
| 2012/0020811 | A1 | 1/2012 | Kraeutler et al. | |
| 2013/0153180 | A1* | 6/2013 | Montocchio | B60K 11/04 165/121 |
| 2013/0239913 | A1 | 9/2013 | Young et al. | |

* cited by examiner

MULTIPLE PLANE RECIRCULATION FAN CONTROL FOR A COOLING PACKAGE

FIELD OF THE DISCLOSURE

The present disclosure relates to cooling fan control on a machine, and in particular to a cooling fan control system for a cooling package with cooling fans on multiple planes.

BACKGROUND

Physically separating distinct cooling zones in a machine cooling system may resolve hot air recirculation to the active fan heat exchangers. This can lead to higher system efficiencies but it may also reduce the cleaning of the cooling package and the efficacy of reversing fans. Any flow divider to separate zones will take up space and will need to seal tightly enough to prevent recirculation airflow. This sealing and complex geometry of dividers and zones may trap dirt and debris. By using passive fans at lower speeds to avoid recirculation, the overall cooling package can become easier to clean with a small tradeoff in cooling system efficiency.

It would be desirable to have a cooling system with an open cooling compartment where the cooling fans on different planes can pull ambient air from the same cooling compartment for cooling various machine systems without causing preheated air to be pulled back through other fans of the cooling system.

SUMMARY

A multiplane fan cooling system is disclosed for a vehicle having a plurality of heat exchangers to cool vehicle systems. The multiplane fan cooling system includes a first plane with a first fan and a first heat exchanger, a second plane with a second fan and a second heat exchanger, an intake plane, a controller and a shared air cavity. The shared air cavity is bounded at least in part by the first, second and intake planes. The first fan is configured to pull ambient air through the intake plane into the shared air cavity and move it across the first plane and first heat exchanger when the first heat exchanger needs cooling. The second fan is configured to pull ambient air through the intake plane into the shared air cavity and move it across the second plane and second heat exchanger when the second heat exchanger needs cooling. The controller is configured to activate the first fan when the first heat exchanger needs cooling; activate the second fan when the second heat exchanger needs cooling; and activate the first fan to counteract air from being drawn into the shared air cavity through the first heat exchanger by the second fan. The controller can also be configured to control a speed of the first fan to counteract air from being drawn into the shared air cavity through the first heat exchanger by the second fan. The controller can also be configured to activate the second fan to counteract air from being drawn into the shared air cavity through the second heat exchanger by the first fan. The controller can also be configured to control a speed of the second fan to counteract air from being drawn into the shared air cavity through the second heat exchanger by the first fan. All of the air in the shared air cavity can be available to each of the first and second fans.

The multiplane fan cooling system can also include a first sensor that provides first temperature readings of a first vehicle system cooled by the first heat exchanger, and a second sensor that provides second temperature readings of a second vehicle system cooled by the second heat exchanger. The controller can determine a first fan speed for the first fan based on the first sensor readings, determine a second fan speed for the second fan based on the second sensor readings, determine a first fan command for the first fan based on the first and second fan speeds, determine a second fan command for the second fan based on the first and second fan speeds; transmit the first fan command to the first fan, and transmit the second fan command to the second fan.

The multiplane fan cooling system can also include a third heat exchanger on the first plane, where the first fan is configured to pull ambient air through the intake plane into the shared air cavity and move it across the first plane and the first and third heat exchangers when the first or third heat exchanger need cooling. The controller can be further configured to activate the first fan when the third heat exchanger needs cooling, and control the speed of the first fan to counteract air from being drawn into the shared air cavity through the first and third heat exchangers by the second fan. The multiplane fan cooling system can also include a first sensor that provides first temperature readings of a first vehicle system cooled by the first heat exchanger, a second sensor that provides second temperature readings of a second vehicle system cooled by the second heat exchanger, and a third sensor that provides third temperature readings of a third vehicle system cooled by the third heat exchanger. The controller can be configured to determine a first fan speed for the first fan based on the first and third sensor readings, determine a second fan speed for the second fan based on the second sensor readings, determine a first fan command for the first fan based on the first and second fan speeds, determine a second fan command for the second fan based on the first and second fan speeds, transmit the first fan command to the first fan, and transmit the second fan command to the second fan.

The multiplane fan cooling system can also include a third fan and a third heat exchanger on the first plane, where the third fan is configured to pull ambient air through the intake plane into the shared air cavity and move it across the first plane and the third heat exchanger when the third heat exchanger needs cooling. The controller can be further configured to activate the third fan when the third heat exchanger needs cooling, control a speed of the first fan to counteract air from being drawn into the shared air cavity through the first heat exchanger by the second fan or the third fan, control a speed of the second fan to counteract air from being drawn into the shared air cavity through the second heat exchanger by the first fan or the third fan, and control a speed of the third fan to counteract air from being drawn into the shared air cavity through the third heat exchanger by the first fan or the second fan. The multiplane fan cooling system can also include a first sensor that provides first temperature readings of a first vehicle system cooled by the first heat exchanger, a second sensor that provides second temperature readings of a second vehicle system cooled by the second heat exchanger, and a third sensor that provides third temperature readings of a third vehicle system cooled by the third heat exchanger. The controller can also be configured to determine a first fan speed for the first fan based on the first sensor readings, determine a second fan speed for the second fan based on the second sensor readings, determine a third fan speed for the third fan based on the third sensor readings, determine a first fan command for the first fan based on the first, second and third fan speeds, determine a second fan command for the second fan based on the first, second and third fan speeds, determine a third fan command for the third fan based on the first, second and third fan speeds, transmit the first fan command to the first fan, transmit the second fan command to the second fan, and transmit the third fan command to the third fan. All of the air in the shared air cavity can be available to each of the first, second and third fans.

A method is disclosed for controlling a multiplane fan cooling system for a vehicle that includes an intake plane, a first heat exchanger plane, a second heat exchanger plane, and a shared air cavity bounded at least in part by the intake plane and the first and second heat exchanger planes. The first heat exchanger plane includes a first fan and a first heat exchanger configured to cool a first vehicle system, and the second heat exchanger plane includes a second fan and a second heat exchanger configured to cool a second vehicle system. The method includes monitoring the first and second vehicle systems to determine if any of the first and second vehicle systems need cooling; when the first vehicle system needs cooling, activating the first fan to draw ambient air into the shared air cavity through the intake plane and out across the first plane and the first heat exchanger; when the second vehicle system needs cooling, activating the second fan to draw ambient air into the shared air cavity through the intake plane and out across the second plane and second first heat exchanger; and activating the first fan to counteract air from being drawn into the shared air cavity through the first heat exchanger by the second fan. The method can also include activating the second fan to counteract air from being drawn into the shared air cavity through the second heat exchanger by the first fan. All of the air in the shared air cavity can be available to each of the first and second fans. The method can also include controlling a speed for the first fan to counteract air from being drawn into the shared air cavity through the first heat exchanger by the second fan, and controlling a speed for the second fan to counteract air from being drawn into the shared air cavity through the second heat exchanger by the first fan.

The method can also include monitoring first sensor readings from a first sensor providing a temperature of the first vehicle system, monitoring second sensor readings from a second sensor providing a temperature of the second vehicle system, calculating a first independent fan speed for the first fan based on the first sensor readings, calculating a second independent fan speed for the second fan based on the second sensor readings, determining a first fan command for the first fan based on the first and second independent fan speeds, determining a second fan command for the second fan based on the first and second independent fan speeds, transmitting the first fan command to the first fan; and transmitting the second fan command to the second fan.

The first heat exchanger plane can also include a third heat exchanger configured to cool a third vehicle system, and the method can also include monitoring the first, second and third vehicle systems to determine if any of the first, second and third vehicle systems need cooling; when the third vehicle system needs cooling, activating the first fan to draw ambient air into the shared air cavity through the intake plane an out across the first plane and the third heat exchanger; and controlling the speed of the first fan to counteract air from being drawn into the shared air cavity through the first and third heat exchangers by the second fan. The method can also include monitoring first sensor readings from a first sensor providing a temperature of the first vehicle system, monitoring second sensor readings from a second sensor providing a temperature of the second vehicle system, monitoring third sensor readings from a third sensor providing a temperature of the third vehicle system, calculating a first independent fan speed for the first fan based on the first and third sensor readings, calculating a second independent fan speed for the second fan based on the second sensor readings, determining a first fan command for the first fan based on the first and second independent fan speeds, determining a second fan command for the second fan based on the first and second independent fan speeds, transmitting the first fan command to the first fan; and transmitting the second fan command to the second fan.

The first heat exchanger plane can also include a third fan and a third heat exchanger configured to cool a third vehicle system, and the method can also include monitoring the first, second and third vehicle systems to determine if any of the first, second and third vehicle systems need cooling; when the third vehicle system needs cooling, activating the third fan to draw ambient air into the shared air cavity through the intake plane an out across the first plane and the third heat exchanger; activating the third fan when the third heat exchanger needs cooling; controlling the speed of the first fan to counteract air from being drawn into the shared air cavity through the first heat exchanger by the second fan or the third fan; controlling the speed of the second fan to counteract air from being drawn into the shared air cavity through the second heat exchanger by the first fan or the third fan; and controlling the speed of the third fan to counteract air from being drawn into the shared air cavity through the third heat exchanger by the first fan or the second fan. The method can also include monitoring first sensor readings from a first sensor providing a temperature of the first vehicle system; monitoring second sensor readings from a second sensor providing a temperature of the second vehicle system; monitoring third sensor readings from a third sensor providing a temperature of the third vehicle system; calculating a first independent fan speed for the first fan based on the first sensor readings; calculating a second independent fan speed for the second fan based on the second sensor readings; calculating a third independent fan speed for the third fan based on the third sensor readings; determining a first fan command for the first fan based on the first, second and third independent fan speeds; determining a second fan command for the second fan based on the first, second and third independent fan speeds; determining a third fan command for the third fan based on the first, second and third independent fan speeds; transmitting the first fan command to the first fan; transmitting the second fan command to the second fan; and transmitting the third fan command to the third fan.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
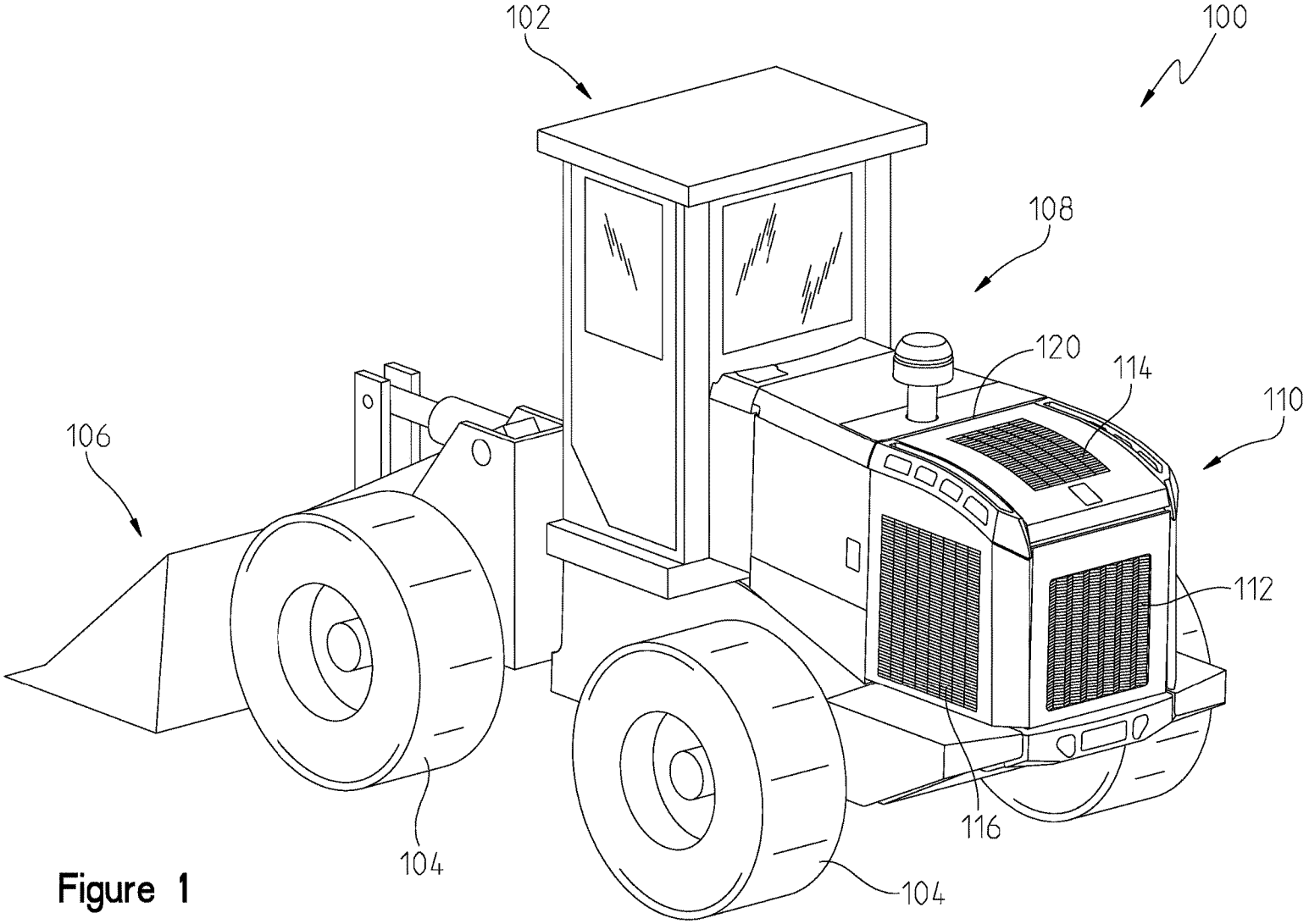
FIG. 1 illustrates an exemplary machine that can include a cooling package with multiple plane recirculation fan control.

FIG. 1 shows an exemplary vehicle, a loader 100, which can include a cooling package with multiple plane recirculation fan control. The loader 100 includes an operator cab 102, traction devices 104, which can be wheels, tracks or other devices, a work implement 106, an engine compartment 108 and a cooling compartment 110. The engine compartment 108 includes an engine that powers the various systems of the loader 100 and these systems can generate heat. The cooling compartment 110 can include a cooling package with multiple fans to cool the various systems of the loader 100. The cooling compartment 110 includes a rear plane 112, a top plane 114, a left side plane 116, a right side plane 118 (opposite the left side plane 116), and a front plane 120. The front plane 120 can include a plate, or baffle, separating the cooling compartment 110 from the engine compartment 108. Some of the planes 112-120 of the cooling compartment 110 can include heat exchangers coupled to various systems of the vehicle 100, and fans to cool these heat exchangers.

The use of multiple planes in a machine cooling package provides opportunities for separate zone cooling. Air flow for the separate zones can be generated with multiple fans that may have independent speed control. Different systems require different cooling, so each zone can have a distinct minimum and maximum temperature fan response. Separate sensors can be used to track the temperatures of the various systems, and to determine when the cooling fans should be activated and the required speeds for the activated cooling fans. One challenge with this arrangement is recirculation when the fans are running at different speeds. Heated air from one heat exchanger with a higher minimum temperature may be pushed into a heat exchanger that requires cooling and this can reduce the cooling capacity of the overall system. Some solutions use a baffle to seal-off and separate the zones from one another, but baffles can reduce the performance of the fans, trap debris and moisture, add weight, and add cost. Instead of a baffle, the cooling system can allow air flow between the zones and control fan speed to counter recirculation of preheated air where it is not desired.

Figure 2:
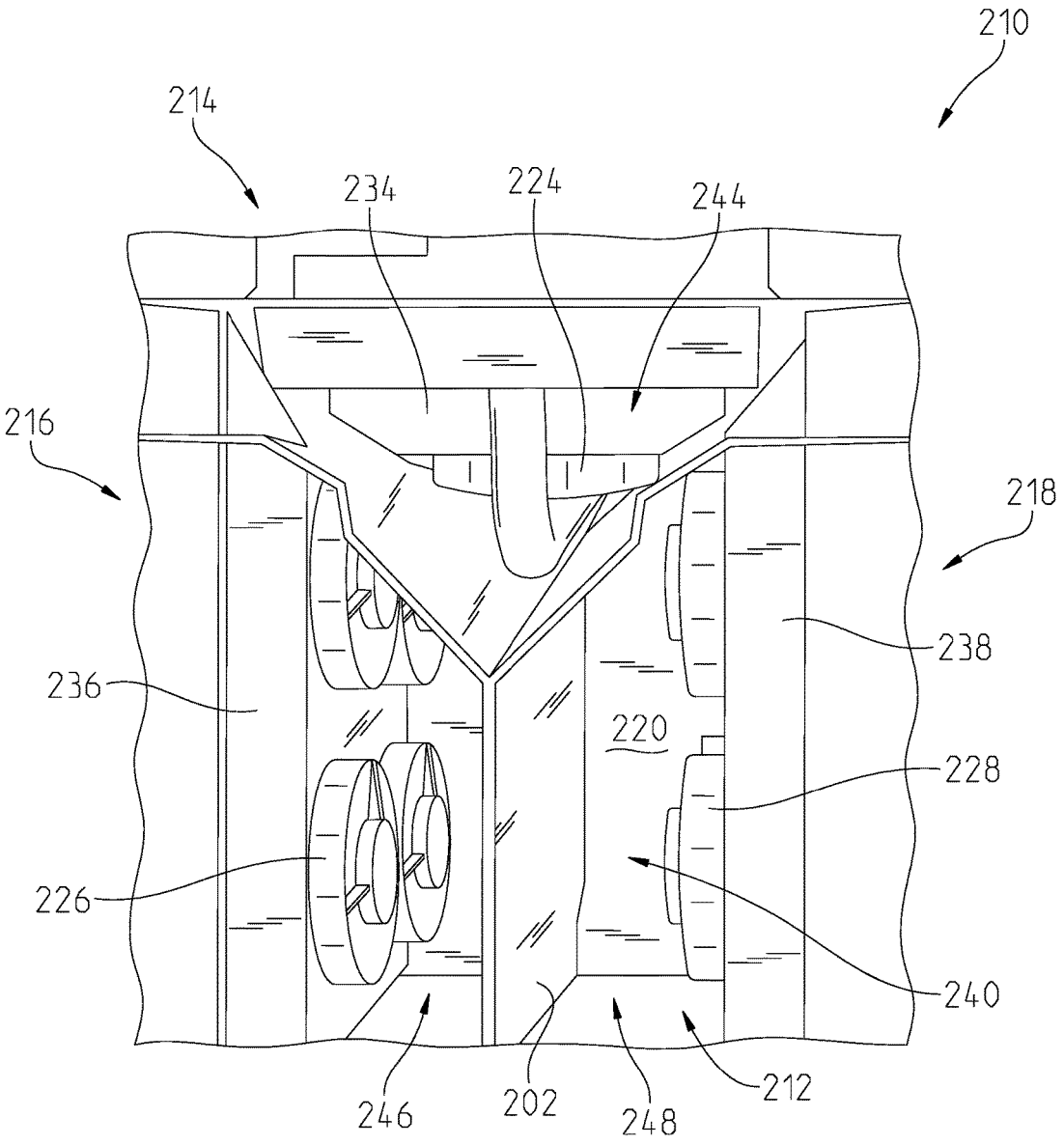
FIG. 2 illustrates an exemplary cooling compartment that includes a cooling package with multiple fans and a baffle.

FIG. 2 illustrates an exemplary cooling compartment 210 that includes a cooling package with an air cavity 240, multiple fans and a baffle 202. The top plane 214 includes one or more fans 224 to cool one or more heat exchangers 234, the left side plane 216 includes one or more fans 226 to cool one or more heat exchangers 236, and the right side plane 218 includes one or more fans 228 to cool one or more heat exchangers 238. The rear plane 212, closest to the viewer, is open to allow the fans to draw fresh, ambient air into the air cavity 240. The front plane 220, furthest from the viewer, is closed to separate the cooling compartment 210 from the engine compartment. The baffle 202 separates the air cavity 240 into three sections: a top section 244 where the top fans 224 on the top plane 214 can pull ambient air through the rear plane 212 to cool the top heat exchangers 234, a left section 246 where the left fans 226 on the left plane 216 can pull ambient air through the rear plane 212 to cool the left heat exchangers 236, and a right section 248 where the right fans 228 on the right plane 218 can pull ambient air through the rear plane 212 to cool the right heat exchangers 238.

The baffle 202 prevents air flow and recirculation between the top section 244, the left section 246, and the right section 248 of the air cavity 240 of the cooling compartment 210. Thus, if the right fans 228 are actively pushing air through the right heat exchangers 238 to cool them, then all of that air being pulled into the right section 248 is ambient air being pulled through the rear plane 212 and not air being pulled from the top section 244 through the top heat exchangers 234 or air being pulled from the left section 246 through the left heat exchangers 236. Similarly, if the right fans 228 are actively pushing air at a relatively high speed through the right heat exchangers 238 to cool them and the left fans 226 are not active because the left heat exchangers 236 do not presently need cooling and the top fans 224 are actively pushing air at a relatively low speed through the top heat exchangers 234 to cool them, then the air being pulled into the right section 248 and the top section 244 is ambient air being pulled through the rear plane 212, and there is no recirculation of preheated air being pulled from the other sections of the air cavity 240 through their associated heat exchangers. These are just a couple of examples of the baffle 202 preventing air flow and recirculation between the multiple sections 244, 246, 248 of the air cavity 240 of the cooling compartment 210, and it applies equally to any pulling and recirculation of preheated air between the various sections of the air cavity 240.

Figure 3:
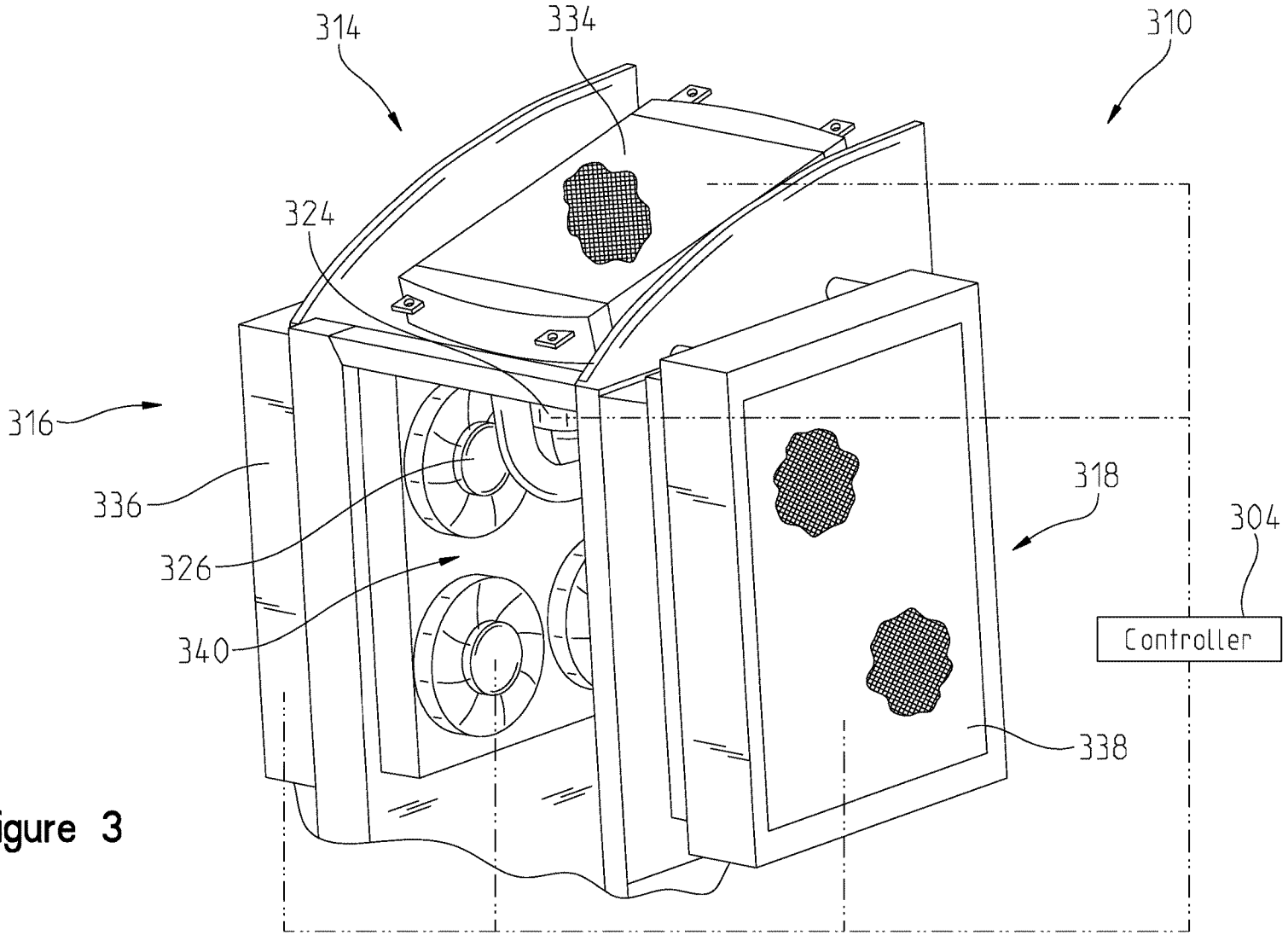
FIG. 3 illustrates a right-rear perspective of an exemplary cooling compartment that includes a cooling package with multiple fans with no separators or baffles.
Figure 4:
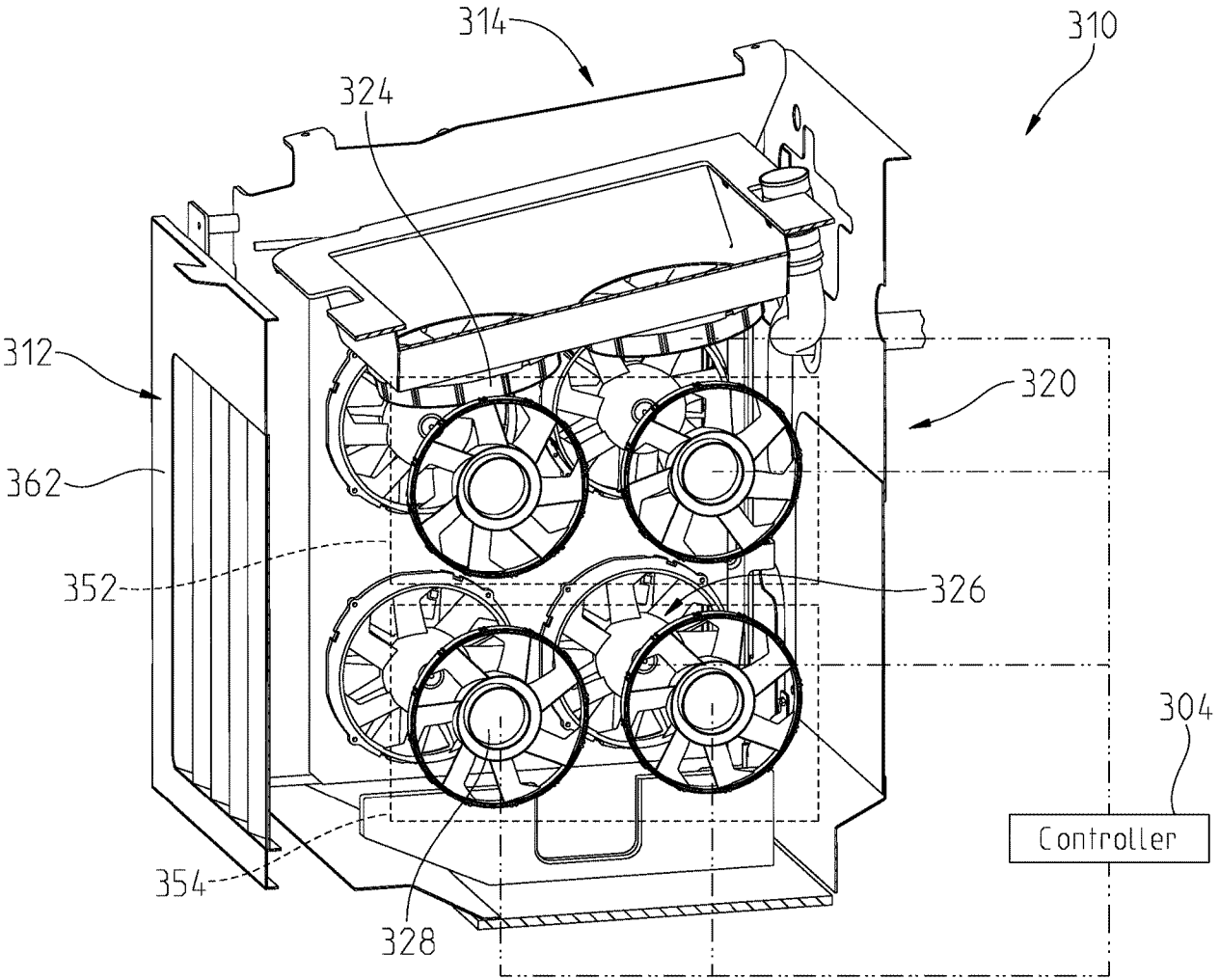
FIG. 4 illustrates a right-side perspective of the cooling compartment of FIG. 3 with the heat exchangers and side walls removed.

FIGS. 3 and 4 illustrate an exemplary cooling compartment 310 that includes a cooling package with a shared air cavity 340, multiple fans and no separators or baffles. FIG. 3 shows the cooling compartment 310 from a right-rear perspective and FIG. 4 shows the cooling compartment 310 with the heat exchangers and side walls removed from a right-side perspective. The top plane 314 includes one or more fans 324 to cool one or more heat exchangers 334, the left side plane 316 includes one or more fans 326 to cool one or more heat exchangers 336, and the right side plane 318 includes one or more fans 328 to cool one or more heat exchangers 338. The rear plane 312 is open to allow the fans 324, 326, 328 to draw fresh, ambient air into the shared air cavity 340. The rear plane 312 may have a screen or grill 362 to help keep debris and dirt from entering the shared air cavity 340. The front plane 320 is closed to separate the cooling compartment 310 from the engine compartment. A cooling system controller 304 receives signals from the heat exchangers 334, 336, 338 indicating whether or not they need cooling, and the cooling system controller 304 can separately activate the fans 324, 326, 328 to pull ambient air through the rear plane 312 into the shared air cavity 340 to cool the associated heat exchangers 334, 336, 338, respectively.

Each of the heat exchangers 334, 336, 338 can include one or more separate heat exchangers for the various systems of the vehicle, for example radiators, hydraulic oil coolers, transmission coolers, refrigerant condensers, fuel coolers, power electronics coolers, etc. These heat exchangers can be separated on the same plane of the cooling compartment 310 and the fans can be grouped based on the separation of the heat exchangers. For example, the right heat exchangers 338 can include a hydraulic oil cooler at the top and a power electronics cooler at the bottom, configured so a top fan group 352 of two fans of the right fans 328 can blow air over the hydraulic oil cooler at the top of the right heat exchangers 338, and a bottom fan group 354 of two fans of the right fans 328 can blow air over the power electronics cooler at the bottom of the right heat exchangers 338. The cooling system controller 304 can be configured to separately activate and deactivate the top fan group 352 as one fan group to cool the hydraulic oil cooler at the top of the right heat exchangers 338, and the bottom fan group 354 as another fan group to cool the power electronics cooler at the bottom of the right heat exchangers 338. The heat exchangers can also be stacked so that air blown by one or more of the fans 324, 326, 328 blows over an inner heat exchanger and then over an outer heat exchanger and then out of the vehicle.

The cooling system controller 304 can activate one or more groups of the fans 324, 326, 328 at low forward speeds to reduce or prevent pulling of preheated air into the shared air cavity 340 through a heat exchanger on another plane of the cooling compartment 310 and recirculation of the heated air generated by an active high speed fan command. For example, if a heat exchanger requests airflow, for example the top heat exchangers 334, the cooling system controller 304 will activate the associated fan group, the top fans 324 at fan speeds sufficient to move the required mass flow rate of air from inside the shared air cavity 340 to cool the top heat exchangers 334. This will create a low pressure inside the shared air cavity 340 which can draw ambient air in through the rear plane 312 and also can reverse air flow through the right and/or left side heat exchangers 336, 338 and fans 326, 328 bringing preheated air back into the shared air cavity 340. This recirculation of preheated air degrades cooling because it is almost always hotter than the ambient air which degrades the cooling of the heat exchangers needing cooling and can overcool a heat exchanger that does not need cooling. To reduce or prevent the pulling of preheated air through the right and/or left side heat exchangers 336, 338, the cooling system controller 304 can activate the right and/or left side fans 326, 328 at a sufficient fan speed to reduce or prevent drawing of air through an inactive fan or reverse flow of air through a fan activated at a lower fan speed into the shared air cavity 340. The cooling system controller 304 can activate any group of fans on any of the cooling planes 314, 316, 318 of the cooling compartment 310 to counteract the pulling of air through a heat exchanger and into the shared air cavity 340 whether the associated fans are not currently needed for cooling or are pushing a smaller mass flow of air than other fans.

When any fan group is activated, the cooling system controller 304 can determine whether one or more other fan groups should be activated to reduce or prevent recirculation of preheated air. A recirculation data matrix can be pre-calculated and used to determine whether other fan groups should be activated. For example, the fans of the embodiment of the cooling compartment 310 shown in FIGS. 3 and 4 can be separated into four groups: a first fan group including four fans 326 on the left side plane 316, a second fan group including a top right fan group 352 of two fans 328 on the right side plane 318, a third fan group including a bottom right fan group 354 of two fans 328 on the right side plane 318, and a fourth fan group of two fans on the top plane 314. The fan groups can be configured based on the various system heat exchanger zones that are included in the top, left and right side heat exchangers 334, 336, 338, respectively. In this example, there is a first heat exchanger zone including one or more heat exchangers on the left side plane 316 cooled by the first fan group, a second heat exchanger zone including one or more heat exchangers at the top of the right side plane 318 cooled by the second fan group, a third heat exchanger zone including one or more heat exchangers at the bottom of the right side plane 318 cooled by the third fan group, and a fourth heat exchanger zone including one or more heat exchangers on the top plane 314 cooled by the fourth fan group.

The cooling system controller 304 can receive temperature readings for the various heat exchangers and determine when to activate each fan group and the appropriate fan speeds, or can receive fan activation commands for each fan group and the appropriate fan speeds. From this information, the cooling system controller 304 can generate a temperature control vector with a commanded fan speed for each fan group. The temperature control vector can be multiplied by the recirculation data matrix to determine the fan speed commands for each fan zone as shown below:

(temperature command 1,temperature command 2,temperature command 3,temperature command 4){matrix}=(zone 1 command,zone 2 command, zone 3 command,zone 4 command)

Additional control zones and additional temperature commands will increase the size of the temperature control vector, the fan zone command vector and the recirculation data matrix.

The recirculation data matrix can be calculated based on the configuration and geometry of the vehicle, the heat exchanger zones, the fan groups and other factors. The recirculation data matrix can be set up to turn the passive fan groups (fan groups where associated heat exchangers do not require air flow) just fast enough to not have air flow through the heat exchangers that do not require cooling; and to increase the speeds of active fan groups (fan groups where associated heat exchangers desire air flow) just fast enough to push the desired air flow through the associated heat exchangers despite the air flow pulled by other fan groups. An example recirculation data matrix is:

$$\begin{matrix} 1 & 0.5 & 0.5 & 0.5 \\ 0 & 1 & 0 & 0 \\ 0 & 0 & 1 & 0 \\ 0 & 0 & 0 & 1 \end{matrix}$$

This recirculation data matrix indicates that when the first fan group is activated, each of the other fan groups is activated at half of the speed of the first fan group to prevent the first fan group from pulling air through heat exchanger zones two, three and four. This recirculation data matrix also indicates that the second, third or fourth fan groups will only pull air through their associated heat exchanger zone, so the other fan groups do not need to be activated to prevent recirculation of preheated air. The recirculation data matrix can have off-axis non-zero terms anywhere necessary to reduce or prevent pulling of air through other heat exchanger zones.

When a fan group is activated, the pre-calculated recirculation data matrix can be used to determine the necessary fan speeds for the other fan groups to reduce or prevent pulling of air through other heat exchanger zones into the shared air cavity 340. As an example, when only the first and fourth heat exchanger zones need cooling and the first fan group should be operated at 50% of maximum speed to provide sufficient cooling for the first heat exchanger zone, and the fourth fan group should be operated at 40% of maximum speed to provide sufficient cooling for the fourth heat exchanger zone, then the temperature control vector could be:

[0.5, 0, 0, 0.4].

Multiplying the example temperature control vector by the example recirculation data matrix results in fan speed commands of:

[0.5, 0.25, 0.25, 0.65]

which indicates that fan group 1 should be run at 50% speed, fan group 2 should be run at 25% speed, fan group 3 should be run at 25% speed, and fan group 4 should be run at 65% speed.

Figure 5:
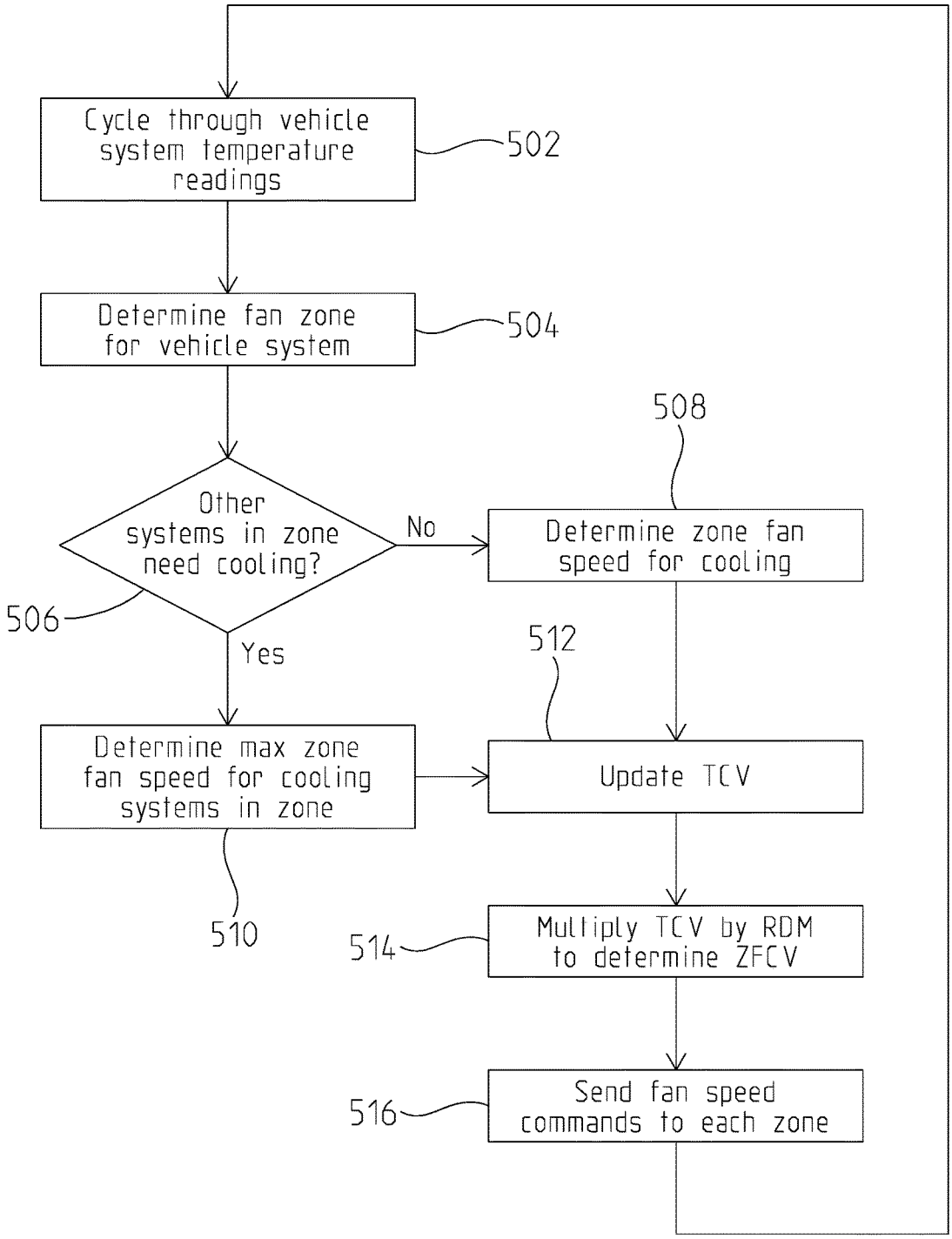
FIG. 5 illustrates an exemplary flow diagram for cooling package fan control.

FIG. 5 illustrates an exemplary flow diagram for cooling package fan control. At block 502, the controller cycles through the vehicle system temperature readings, for example temperature readings for engine coolant, front axle coolant, rear axle coolant, brakes, transmission oil, hydraulic oil, charged air cooler, fuel temperature, etc. For each of the vehicle system temperature readings, at block 504 the controller determines the fan zone that cools that particular vehicle system. At block 506, the controller checks whether other vehicle systems cooled by that fan zone need cooling. If no other vehicle systems cooled by that fan zone need cooling then control passes to block 508, otherwise control passes to block 510.

If no other vehicle systems cooled by that fan zone need cooling then, at block 508, the controller determines the fan speed for that fan zone to provide the necessary cooling of that particular system. Control then passes to block 512.

If other vehicle systems cooled by that fan zone need cooling then, at block 510, the controller determines the maximum fan speed required for that fan zone to provide the necessary cooling of the vehicle systems that need cooling. Control then passes to block 512.

At block 512, the controller updates the temperature control vector (TCV) with the zone fan speed determined at block 508 or block 510. The zone fan speed can be a value between 0 and 1, where 0 means the fan does not need to be run and 1 indicates the fan should be run at full speed. At block 514, the controller multiples the temperature control vector by the recirculation data matrix (RDM) to determine the zone fan command vector (ZFCV) with the fan speed commands for each fan zone. As explained above, the RDM can be calculated to take into account any necessary fan speed to counteract the recirculation of preheated air through the shared air cavity. At block 516, the controller sends the fan speed commands to each fan zone. The controller then cycles back to block 502 to process the temperature reading for the next vehicle system.

Over time, debris can build up on the various faces of the cooling compartment and interfere with the system recirculation control. The fan groups can be activated in reverse to clear or reduce the debris on the various faces of the cooling compartment.

As an alternative to using the pre-calculated recirculation data matrix, air flow sensors can be used to provide readings for the direction and mass flow of air through each of the heat exchanger zones and the cooling system controller can activate the associated fan groups for each heat exchanger zone to the necessary speed to counteract recirculation and provide the desired air flow through each heat exchanger zone.

As another alternative, temperature sensors can be used to provide temperature readings inside the shared air cavity near each fan group and the cooling system controller can take into account the heat exchanger zone temperature and the temperature inside the shared air cavity near the associated fan group to determine the necessary speed to counteract recirculation and provide the desired air flow through each heat exchanger zone.

As yet another alternative, fan temperature sensors can be used as feedback. A fan temperature sensor can be embedded in each fan and the cooling system controller can take into account the fan temperatures to determine the necessary speed to reduce or prevent recirculation and provide the desired air flow. This could reduce the overall cost of the system and protect the sensor. It could also allow the system to cool off the internals of the fans to provide longer fan life.

Recirculation is also a risk in the event of a fan failure in a cooling zone. If the other fans in the zone increase speed to maintain vehicle operation, then this can increase recirculation at the location of the failed fan. Temperature sensors could be used to sense a fan failure if the fan did not provide feedback to the cooling system controller 304.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. A multiplane fan cooling system for a vehicle having a plurality of heat exchangers to cool vehicle systems, the multiplane fan cooling system comprising:

a first plane;

a first heat exchanger on the first plane;

a first sensor that provides first temperature readings of a first vehicle system cooled by the first heat exchanger; and a second plane;

a second heat exchanger on the second plane;

a second sensor that provides second temperature readings of a second vehicle system cooled by the second heat exchanger;

an intake plane;

a shared air cavity bounded at least in part by the first plane, second plane and intake plane;

a first fan on the first plane, the first fan configured to pull ambient air through the intake plane into the shared air cavity and move the ambient air across the first plane and the first heat exchanger when the first heat exchanger needs cooling;

a second fan on the second plane, the second fan configured to pull ambient air through the intake plane into the shared air cavity and move the ambient air across the second plane and the second heat exchanger when the second heat exchanger needs cooling; and a controller configured to:

activate the first fan when the first heat exchanger needs cooling;

activate the second fan when the second heat exchanger needs cooling;

activate the first fan to counteract air from being drawn into the shared air cavity through the first heat exchanger by the second fan;

activate the second fan to counteract air from being drawn into the shared air cavity through the second heat exchanger by the first fan;

control a speed of the first fan to counteract air from being drawn into the shared air cavity through the first heat exchanger by the second fan; and control a speed of the second fan to counteract air from being drawn into the shared air cavity through the second heat exchanger by the first fan;

wherein the controller determines a first fan speed for the first fan based on the first sensor readings, determines a second fan speed for the second fan based on the second sensor readings, determines a first fan command for the first fan based on the first and second fan speeds, determines a second fan command for the second fan based on the first and second fan speeds; transmits the first fan command to the first fan and transmits the second fan command to the second fan.

2. The multiplane fan cooling system of claim 1, wherein all of the air in the shared air cavity is available to each of the first and second fans.

3. A multiplane fan cooling system for a vehicle having a plurality of heat exchangers to cool vehicle systems, the multiplane fan cooling system comprising:

a first plane;

a first heat exchanger on the first plane;

a second plane;

a second heat exchanger on the second plane;

a third heat exchanger on the first plane;

an intake plane;

a shared air cavity bounded at least in part by the first plane, second plane and intake plane;

a first fan on the first plane, the first fan configured to pull ambient air through the intake plane into the shared air cavity and move the ambient air across the first plane and the first and third heat exchangers when the first or third heat exchanger needs cooling;

a second fan on the second plane, the second fan configured to pull ambient air through the intake plane into the shared air cavity and move the ambient air across the second plane and the second heat exchanger when the second heat exchanger needs cooling; and a controller configured to:

activate the first fan when the first heat exchanger needs cooling;

activate the first fan when the third heat exchanger needs cooling;

activate the second fan when the second heat exchanger needs cooling;

activate the first fan to counteract air from being drawn into the shared air cavity through the first heat exchanger by the second fan;

activate the second fan to counteract air from being drawn into the shared air cavity through the second heat exchanger by the first fan; and control a speed of the first fan to counteract air from being drawn into the shared air cavity through the first and third heat exchangers by the second fan; and control a speed of the second fan to counteract air from being drawn into the shared air cavity through the second heat exchanger by the first fan.

4. The multiplane fan cooling system of claim 3, further comprising:

a first sensor that provides first temperature readings of a first vehicle system cooled by the first heat exchanger;

a second sensor that provides second temperature readings of a second vehicle system cooled by the second heat exchanger; and a third sensor that provides third temperature readings of a third vehicle system cooled by the third heat exchanger;

wherein the controller is configured to:

determine a first fan speed for the first fan based on the first and third sensor readings;

determine a second fan speed for the second fan based on the second sensor readings;

determine a first fan command for the first fan based on the first and second fan speeds;

determine a second fan command for the second fan based on the first and second fan speeds;

transmit the first fan command to the first fan; and transmit the second fan command to the second fan.

5. The multiplane fan cooling system of claim 3, wherein all of the air in the shared air cavity is available to each of the first and second fans.

6. A multiplane fan cooling system for a vehicle having a plurality of heat exchangers to cool vehicle systems, the multiplane fan cooling system comprising:

a first plane;

a first heat exchanger on the first plane;

a second plane;

a second heat exchanger on the second plane;

a third heat exchanger on the first plane;

a first fan on the first plane, the first fan configured to pull ambient air through the intake plane into the shared air cavity and move the ambient air across the first plane and the first heat exchanger when the first heat exchanger needs cooling;

a second fan on the second plane, the second fan configured to pull ambient air through the intake plane into the shared air cavity and move the ambient air across the second plane and the second heat exchanger when the second heat exchanger needs cooling;

a third fan on the first plane, the third fan configured to pull ambient air through the intake plane into the shared air cavity and move the ambient air across the first plane and the third heat exchanger when the third heat exchanger needs cooling; and a controller configured to:

activate the first fan when the first heat exchanger needs cooling;

activate the second fan when the second heat exchanger needs cooling;

activate the third fan when the third heat exchanger needs cooling;

activate the first fan to counteract air from being drawn into the shared air cavity through the first heat exchanger by the second fan;

activate the second fan to counteract air from being drawn into the shared air cavity through the second heat exchanger by the first fan;

control a speed of the first fan to counteract air from being drawn into the shared air cavity through the first heat exchanger by the second fan or the third fan;

control a speed of the second fan to counteract air from being drawn into the shared air cavity through the second heat exchanger by the first fan or the third fan; and control a speed of the third fan to counteract air from being drawn into the shared air cavity through the third heat exchanger by the first fan or the second fan.

7. The multiplane fan cooling system of claim 6, further comprising:

a first sensor that provides first temperature readings of a first vehicle system cooled by the first heat exchanger;

a second sensor that provides second temperature readings of a second vehicle system cooled by the second heat exchanger; and a third sensor that provides third temperature readings of a third vehicle system cooled by the third heat exchanger;

wherein the controller is configured to:

determine a first fan speed for the first fan based on the first sensor readings;

determine a second fan speed for the second fan based on the second sensor readings;

determine a third fan speed for the third fan based on the third sensor readings;

determine a first fan command for the first fan based on the first, second and third fan speeds;

determine a second fan command for the second fan based on the first, second and third fan speeds;

determine a third fan command for the third fan based on the first, second and third fan speeds;

transmit the first fan command to the first fan;

transmit the second fan command to the second fan; and transmit the third fan command to the third fan.

8. The multiplane fan cooling system of claim 6, wherein all of the air in the shared air cavity is available to each of the first, second and third fans.

* * * * *